United States Patent [19]

Charles

[11] 4,230,286

[45] * Oct. 28, 1980

[54] CORE HOLDER FOR REELING

[75] Inventor: Richard J. Charles, Green Bay, Wis.

[73] Assignee: Paper Converting Machine Company, Green Bay, Wis.

[ * ] Notice: The portion of the term of this patent subsequent to Nov. 13, 1996, has been disclaimed.

[21] Appl. No.: 49,286

[22] Filed: Jun. 18, 1979

Related U.S. Application Data

[63] Continuation-in-part of Ser. No. 921,579, Jul. 3, 1978, Pat. No. 4,174,077.

[51] Int. Cl.[3] ..... B65H 75/02; B65H 19/12; B65H 19/30

[52] U.S. Cl. ..... 242/68.6; 242/58.6; 264/239

[58] Field of Search ..... 242/68.6, 68.5, 68.4, 242/58.6, 118.61, 68.1, 68.2, 55.2, 55; 206/389, 390, 412, 413, 415, 416; 264/239

[56] References Cited

U.S. PATENT DOCUMENTS

| | | | |
|---|---|---|---|
| 2,599,720 | 6/1952 | Prevost | 242/58.6 |
| 3,838,829 | 10/1974 | Gotze | 242/68.4 |
| 3,941,328 | 3/1976 | Johnson | 242/68.4 |
| 4,174,077 | 11/1979 | Charles | 242/68.6 |

FOREIGN PATENT DOCUMENTS

| | | | |
|---|---|---|---|
| 588753 | 2/1959 | Italy | 242/58.6 |

*Primary Examiner*—Stanley N. Gilreath
*Attorney, Agent, or Firm*—Tilton, Fallon, Lungmus & Chestnut

[57] ABSTRACT

A core holder for reeling which includes a relatively elongated metal tube and a plastic sleeve fixed on the tube with the sleeve having radially outwardly projecting therefrom a plurality of longitudinally extending ribs, the ribs being grindable to a predetermined radius.

2 Claims, 3 Drawing Figures

CORE HOLDER FOR REELING

This application is a continuation-in-part of copending application Ser. No. 921,579 filed July 3, 1978, now U.S. Pat. No. 4,174,077.

BACKGROUND AND SUMMARY OF INVENTION

This invention relates to a core holder for reeling and method of making the same and, more particularly, to a unitary device which is used to support a parent roll of web material such as paper incident to converting. Illustrative of the field of application of the invention is the art of rewinding toilet paper and toweling. Such web material is provided in jumbo or parent rolls which may range up to 5 feet in diameter and 5 to 10 feet in axial length. These are the rolls that are removed from the paper machine and are usually transported to another section of the mill for conversion, i.e., unwinding, transverse perforation and rewinding into the well known commerical sized rolls.

As paper machines run faster and become wider, the diameter of the reel bar increases to overcome deflection and consequently, parent roll core diameters increase—this in turn, resulting in a requirement for larger diameter core plugs (inserts) for converting operations.

When preparing a parent roll for use on a converting machine, core inserts are manually pushed into each end of the parent roll core until a flange prevents further insertion. Each insert has entended "journals" which are used for hoisting and transporting the roll into a converting machine.

Each core insert has a relief in the end of its journal and when the parent roll—insert(s) assembly is properly positioned in an unwinding stand, this assembly is held fast between two rotatable spindles which have been pneumatically, slidably moved inward toward the parent roll and into the reliefs in said insert journals.

In conventional practice, steel core plugs (inserts) of about 11" diameter can weigh about 85 pounds and since these plugs must be handled manually when preparing a parent roll for converting, this fatiguing and difficult work is necessary every time a parent roll change is required. This is not an infrequent occurrence inasmuch as many converting lines operate at the rate of about 2,000 feet per minute.

The invention makes use of a plastic core plug but one which differs substantially from the previously employed steel core plug. The prior art steel core plug had a stub tube axially connected to a much larger tube which in turn fitted within the paperboard core. Attempts to duplicate this in lighter weight plastic failed because of the inadequate strength of the plastic.

According to the instant invention, a first or inner tube is constructed of steel and has adjacent to but spaced from one end a radially projecting flange. After this inner tube has been fashioned, there is fixed to the tube a sleeve which is disposed primarily adjacent the other end and terminates a spaced distance from the tube flange. This sleeve is equipped with a plurality of longitudinally extending ribs, the ribs projecting radially outwardly from the sleeve. A flange is provided on the sleeve to cooperate with the tube flange in defining a socket or annulus for a lifting chain hook and the sleeve flange also rigidifies the ribs at the critical outer end thereof where stresses can be maximized. By virtue of fixing the sleeve onto the inner tube, a variety of core plugs can be developed. Also, because of the material of construction, it is relatively simple to grind down the ribs to predetermined radii so that a wide range of core insert sizes can be molded from a small number of molds.

Other objects and advantages of the invention may be seen in the details of construction and operation set down in the ensuing specification.

DETAILED DESCRIPTION

The invention is described in conjunction with the accompanying drawing, in which—

Figure 1:
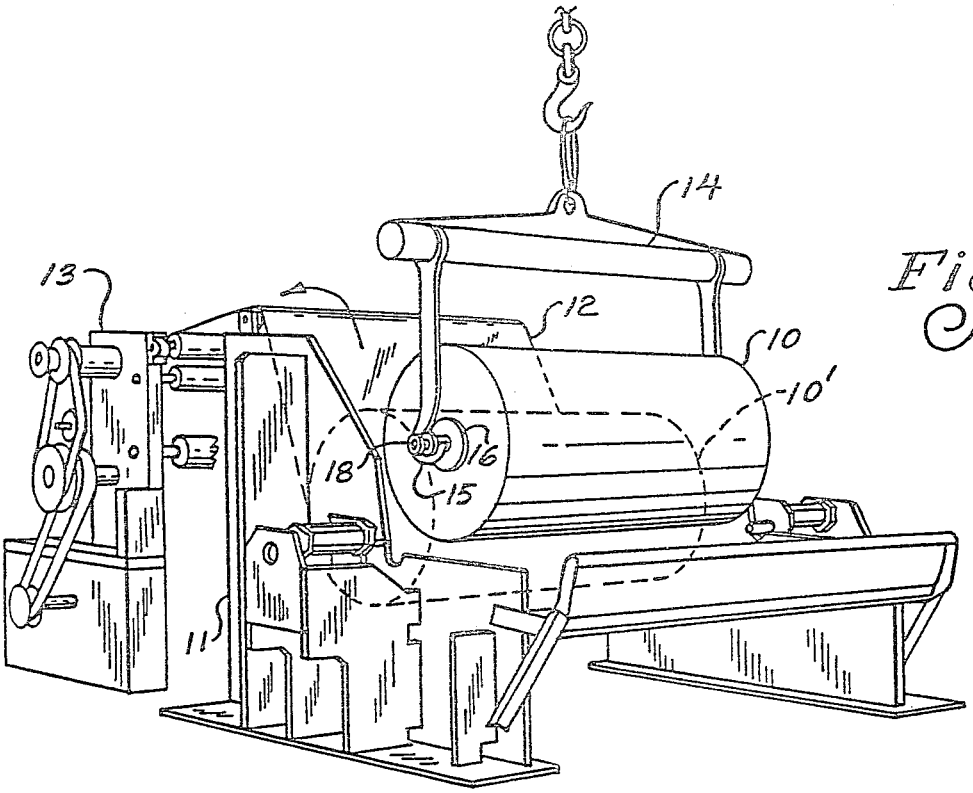
FIG. 1 is a fragmentary perspective view of a portion of a paper converting machine showing a parent roll supported on core inserts made according to the instant invention, the inserts in turn being supported at their extended journals by a typical lifting bar-hood arrangement in preparation for lowering the roll-inserts into an operating station.

Referring now to FIG. 1, the numeral 10 designates generally a parent roll which, as mentioned previously, may be several feet in diameter and a number of feet long. Normally in a paper converting plant, the parent roll 10 is supported on an unwind stand 11 for unwining into a web 12 which is then processed through a converting machine 13.

Featured above the solid portion of the view in FIG. 1 is a presentation which includes a hoisting bar 14 terminating in hooks 15 which support journals of the core inserts generally designated 16 and constitute the subject of this invention.

Figure 2:
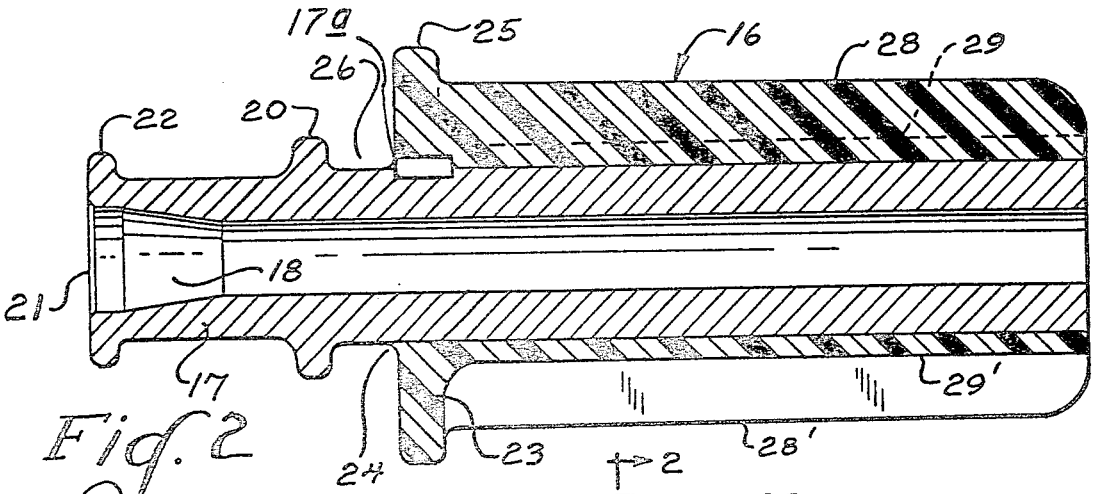
FIG. 2 is a longitudinal sectional view of a core plug constructed according to the invention and corresponds essentially to that which would be seen along the sight line 2—2 applied to FIG. 3.

A typical core plug 16 is seen in FIG. 2. It includes an inner tube or cylinder 17 which is advantageously constructed of a metal material such as steel. The tube 17 is seen to have a recess 18 from which point the parent roll-insert(s) assembly is supported by movable rotatable spindles when lowered to the operating position (see dotted 10' in FIG. 1). Advantageously, the tube 17 is fashioned by casting and is equipped with a radially extending flange 20 adjacent to but spaced from the outer end 21 thereof. Inner tube 17 is equipped with another flange 22 which cooperates with the spindle (not shown) that fits in confining the core plug 16 against axial movement when the parent roll-insert(s) assembly is supported on the unwind stand 11.

Figure 3:
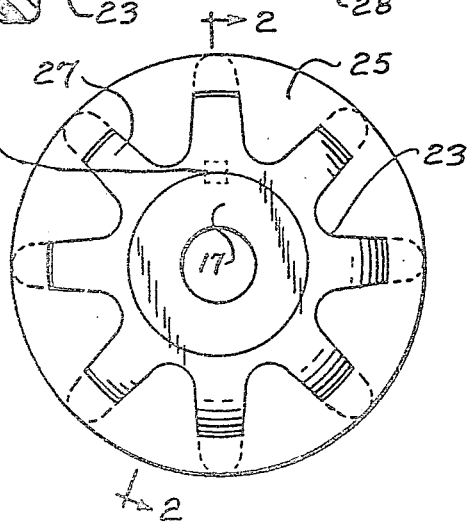
FIG. 3 is an end elevational view of the core plug of FIG. 2.

The core insert 16 includes a sleeve 23 which is advantageously molded of polyurethane material and fixed to the inner tube 17 as by a key 17*a*. The sleeve 23 includes a radially projecting flange 25 at one end thereof and which is positioned a spaced distance away from the flange 20 to provide an annulus or hook-receiving pocket 26. Flange 25 also acts as a stop when the insert is fully inserted. Extending longitudinally away from the flange 25 are a plurality of radially projecting ribs 27. As can be appreciated from a consideration of the dotted portions of FIG. 3, the ribs can be ground down. From the maximum molded diameter 28 and 28' to a smaller predetermined diameter as at 29 and 29'.

For example, the sleeve 23 when initially molded may have ribs which have an overall diameter of 12⅝" and which can be ground down to $9\frac{5}{8}''$. With another mold, the sleeve can provide a range of rib diameters of $9\frac{5}{8}''$ to about $6\frac{1}{2}''$.

I claim:

1. A core holder for reeling comprising a relatively elongated metal tube having a radially extending flange adjacent to but spaced from one end of said tube, a plastic sleeve fixed on said tube adjacent the other end of said tube and terminating a spaced distance from said flange, said sleeve having radially outwardly projecting therefrom a plurality of longitudinally extending ribs.

2. The structure of claim 1 in which said sleeve includes an integral radially extending flange at one end thereof, said sleeve and tube flanges cooperating to define an annulus for receipt of a lifting hook.

* * * * *